US006049347A

United States Patent [19]

Ewert et al.

[11] Patent Number: 6,049,347

[45] Date of Patent: Apr. 11, 2000

[54] APPARATUS FOR VARIABLE IMAGE PRINTING ON TAPE

[75] Inventors: Brian C. Ewert, Charlotte, N.C.; John S. Roberts, Carson City; George S. Patterson, Dayton, both of Nev.

[73] Assignee: J.I.T. Technologies, Inc., Carson City, Nev.

[21] Appl. No.: 08/956,729

[22] Filed: Oct. 23, 1997

Related U.S. Application Data

[60] Provisional application No. 60/039,921, Mar. 7, 1997.

[51] Int. Cl.[7] ..... B41J 15/04

[52] U.S. Cl. ..... 347/215

[58] Field of Search ..... 347/215, 217, 347/218, 219, 221; 400/248, 236, 235, 615.2; 156/64, 351; 428/195

[56] References Cited

U.S. PATENT DOCUMENTS

| | | | |
|---|---|---|---|
| 4,072,224 | 2/1978 | Barnaby | 400/124.11 |
| 4,161,138 | 7/1979 | Marchetti . | |
| 4,321,103 | 3/1982 | Lindtrom et al. | 156/351 |
| 4,577,199 | 3/1986 | Saiki et al. | 347/219 |
| 4,707,211 | 11/1987 | Shibata . | |
| 4,784,714 | 11/1988 | Shibata . | |
| 4,815,871 | 3/1989 | McGourty et al. | 400/120.1 |
| 4,839,742 | 6/1989 | Nakatani | 358/296 |
| 5,168,814 | 12/1992 | Kuzuya | 101/487 |
| 5,193,926 | 3/1993 | Kuzuya | 400/719 |
| 5,295,753 | 3/1994 | Godo | 400/612 |
| 5,302,034 | 4/1994 | Kitazawa | 400/615.2 |
| 5,308,173 | 5/1994 | Amano | 400/29 |
| 5,399,036 | 3/1995 | Yamaguchi | 400/236 |
| 5,419,648 | 5/1995 | Nagao | 400/208 |
| 5,425,823 | 6/1995 | Woodside, III | 156/64 |
| 5,431,763 | 7/1995 | Bradshaw . | |
| 5,443,318 | 8/1995 | Kitazawa | 400/120.1 |
| 5,487,337 | 1/1996 | Uland | 101/288 |
| 5,494,360 | 2/1996 | Watanabe | 400/83 |
| 5,497,701 | 3/1996 | Uland | 101/288 |
| 5,503,485 | 4/1996 | Nakazato | 400/613 |
| 5,614,928 | 3/1997 | Matsuda . | |
| 5,658,647 | 8/1997 | Magill et al. | 428/195 |
| 5,674,345 | 10/1997 | Nash . | |
| 5,750,004 | 5/1998 | Wurz et al. . | |
| 5,857,789 | 1/1999 | Day et al. | 400/615.2 |

*Primary Examiner*—N. Le
*Assistant Examiner*—Anh T. W. Vo
*Attorney, Agent, or Firm*—Christopher C. Dremann, PC; Christopher C. Dremann

[57] ABSTRACT

An apparatus for printing variable identifying information on the face of tape is disclosed. In a particular application, the apparatus replaces a labeling station and is combined with a case sealing station to seal cases of products with adhesive sealing tape on a conventional production line. The apparatus includes a variable image printer, and preferably a thermal printer. The thermal printer preferably includes a thermal transfer print head and a thermal transfer ribbon. The tape is dispensed from a tape unwind spool and is routed past the print head with the thermal transfer ribbon positioned between the print head and the face of the tape, and the face of the tape opposite the print head. The thermal transfer ribbon is specially formulated to be compatible with the physical characteristics and chemical composition of the tape. Accordingly, the apparatus can be utilized to label any desired surface with tape having variable identifying information, such as product codes, stock or lot numbers, bar codes, and shipping data printed thereon. In a preferred embodiment the variable image printer is controlled from a standard operator control panel of a controller integrated with the variable image printer.

4 Claims, 7 Drawing Sheets

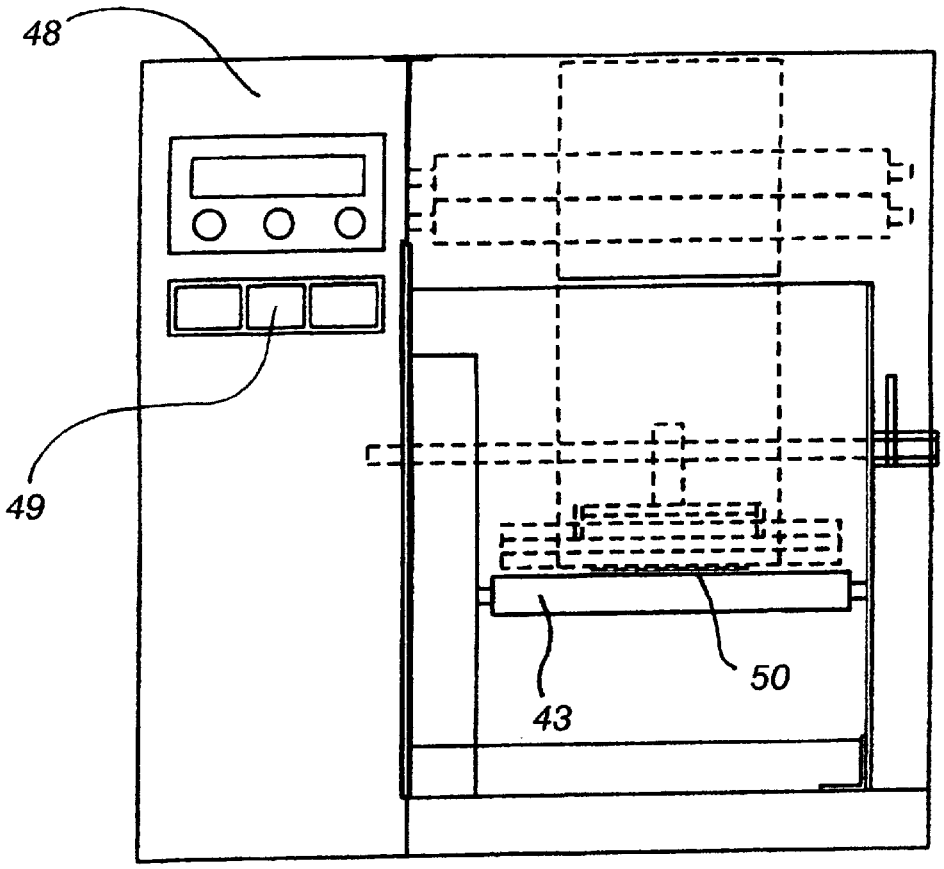
Fig.4b
Fig.4a
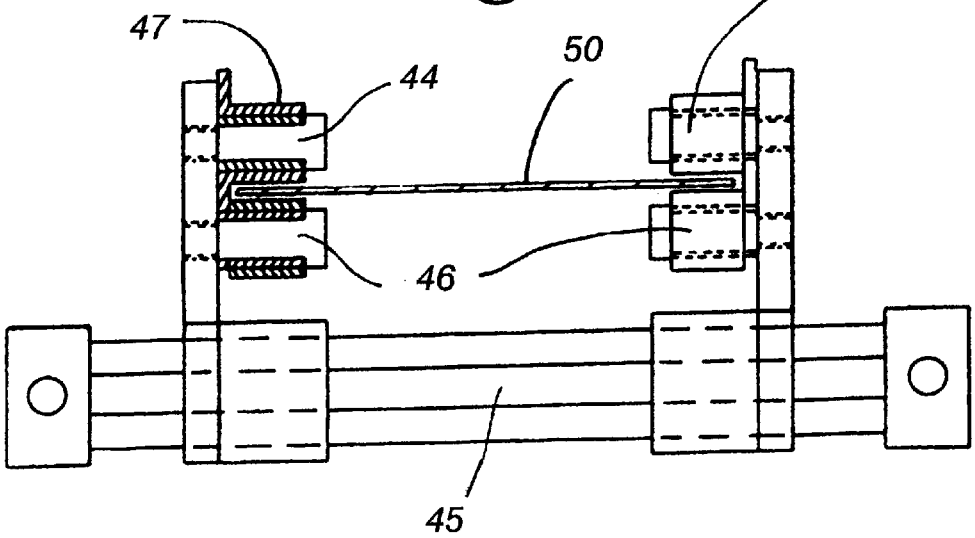

APPARATUS FOR VARIABLE IMAGE PRINTING ON TAPE

CROSS-REFERENCE TO RELATED APPLICATIONS

This application claims the benefit of U.S. Provisional Application Ser. No. 60/039,921 filed Mar. 7, 1997.

FIELD OF THE INVENTION

The invention relates generally to an apparatus for variable image printing on tape. More particularly, the invention is a thermal printer for printing variable identifying information on tape.

BACKGROUND OF THE INVENTION

Manufacturers of products who ship their goods in a container, such as a cardboard box or carton generally referred to as a case, often desire to apply a label to the outside of the case. The label typically has identifying information, such as product codes, stock or lot numbers, bar codes and shipping data, printed thereon to identify the manufacturer of the goods, the contents of the case or the destination of the case. The label has a first side on which the identifying information is printed, and a second side opposite the first side which is coated with a pressure sensitive adhesive. The adhesive side of the label is applied to the outside of the case so that the identifying information on the printed side of the label is available to be read either manually or by an electronic scanner.

If the identifying information for many successive cases is the same, it can be pre-printed on the label, for example, by a flexo-graphic printing process. Often, however, the identifying information varies for each case, or for a series of cases, so that the manufacturer, the contents, or the destination of each case, or series of cases, can be separately identified. The present practice is to print the variable identifying information on labels, commonly known as linerless label stock because the adhesive side of the label is not protected by a liner coated with a release film, immediately before the label is applied to the case. The process of printing variable information on each label, or on a series of labels, is known as variable image printing.

Label stock, however, is expensive relative to conventional tape and requires specially designed equipment to apply the label to the case. Conventional tape is manufactured and wound on a spool which can be easily mounted onto a tape unwind spool spindle driven by a conventional motor. Label stock, on the other hand, is typically manufactured in thin sheets and is applied to the case by a tamp head positioned on the end of a pneumatic or hydraulic tamp. The label stock is held on the face of the tamp by creating a vacuum behind the tamp head and is transferred to the case by activating an air jet in the direction of the case. The equipment required to position the label stock on the tamp head and to transfer the label to the case is susceptible to misfeeding and malfunctioning. Thus, the cost of variable image printing on label stock and the complexity of applying the label to a case reduces the efficiency and productivity of the labeling process.

The same manufacturers often utilize automated production lines to package, seal, label and route cases containing the goods. A typical production line includes a sealing station, at which the case is sealed, for example with an adhesive sealing tape, and a labeling station, at which a label is applied to the case. If variable information is to be printed on the label, the labeling station also includes a variable image printer. It has long been recognized that combining the sealing and labeling stations would result in increased productivity, and thus reduce costs. However, the full advantages of a combined sealing and labeling station cannot be realized unless the combined station is capable of printing variable identifying information onto a label and applying the label to a case at the speed of the production line.

Manufacturers presently combine the tasks of sealing and labeling cases only when the information to be printed on the labels is constant. This is accomplished by utilizing adhesive sealing tape having the identifying information preprinted on the face of the tape. It has previously proven to be difficult for manufacturers to combine the tasks of sealing and labeling when the information to be printed on the labels is variable. The primary reason is that the adhesive side of the tape is exposed as the tape unwinds from the tape spool and must be supported opposite the pressure of the print head as the ink is transferred to the face of the tape. Another reason is that the tape must be printed at a rate that is compatible with the speed of the production line.

The adhesive side of the tape can be supported by a print, or platen, roller having a teflon or plasma coating, or that is coated with a release film. However, the type of adhesive sealing tape typically selected for sealing cases generally utilizes an exceptionally strong adhesive to insure that the case does not break open during handling. Over time, the adhesive can accumulate on the roller, or remove the release film from the roller, thereby causing the tape to inadequately label or seal the case. Thus, the condition of the roller and the tape must be monitored closely, and the roller must be re-coated at regular intervals, thereby decreasing the productivity of the production line and increasing the maintenance required to operate the combined labeling and sealing station on the production line.

A coating that must be wetted to activate the adhesive could be used, and the tape could be variable imaged printed before the adhesive is wetted. The platen roller would then be able to support the dry adhesive side of the tape against the pressure of the print head while the variable identifying information is printed on the face of the tape. However, dry adhesive sealing tapes which require wetting prior to application do not typically produce an adhesive bond that is adequate to insure that the case does not break open during handling. Further, the use of a dry adhesive tape that must be wetted to activate the adhesive would require the introduction of an additional mechanism to wet the adhesive. Such an additional mechanism would increase the complexity of the sealing and labeling station, thereby decreasing the productivity of the production line and increasing the maintenance required to operate the combined station on the production line.

As is apparent, there is a need for an apparatus for variable image printing on tape instead of label stock. More specifically, there is a need for an apparatus for variable image printing on tape that is to be applied to a shipping case to convey identifying information, such as product codes, stock or lot numbers, bar codes and shipping data, which identifies the manufacturer of the goods, the contents of the case or the destination of the case.

In particular, a sealing and labeling station is needed that is capable of printing variable identifying information on adhesive sealing tape without decreasing the productivity of the station, or increasing the complexity and maintenance of the station. Such a sealing and labeling station, for example, would make it possible to combine the tasks of sealing and labeling a case on a production line with variable identifying information.

Accordingly, it is a principle object of the invention to provide an apparatus for variable image printing on tape instead of label stock. More particularly, it is an object of the invention to provide a thermal printer for printing variable identifying information, such as product codes, stock or lot numbers, bar codes and shipping data, on tape that is to be applied to an exterior surface of a shipping case to identify the manufacturer of the goods, the contents of the case or the destination of the case.

It is a further object of the invention to provide a combined sealing and labeling station including a thermal printer for sealing and labeling a case on a production line with adhesive sealing tape having variable identifying information printed on the tape.

It is yet another object of the invention to provide a combined sealing and labeling station including a thermal printer for sealing and labeling a case on a production line that is capable of printing variable identifying information on the face of adhesive sealing tape without decreasing the productivity or increasing the complexity and maintenance of the combined station.

SUMMARY OF THE INVENTION

Broadly, the invention is an apparatus for variable image printing on tape, as opposed to some other media such as label stock. More specifically, the invention is a thermal printer for variable image printing identifying information, such as product codes, stock or lot numbers, bar codes and shipping data, on tape that is to be applied to the exterior of a shipping case to permit the manufacturer, contents or shipping data for each case, or for a series of cases, to be separately identified. In a particular embodiment, the invention is a combined sealing and labeling station including a thermal printer for sealing and labeling a case on a production line with adhesive sealing tape having variable identifying information printed on the tape. In the particular example disclosed, the apparatus prints the variable identifying information on the face of the adhesive sealing tape, and the tape is used to label the case or to securely seal the case for shipment or storage.

The apparatus includes a tape unwind spool rotatably mounted onto a tape unwind spool spindle. The tape is wound on the tape unwind spool in a conventional manner, and the spool rotates freely about the tape unwind spool spindle so that the tape may be unwound from the spool on demand. The tape is routed past a variable image printer to a tape dispensing arm which applies the tape to, for example, the shipping case, in a known manner. A tape cutter cuts the tape to the length required for the particular size label to be applied to the case, or to the length required to securely seal the case.

The variable image printer is provided with a series of tape guides and rollers for delivering the tape to the print head to print the variable identifying information on the tape. In a preferred embodiment, the variable image printer is a thermal printer and the series of tape guides and rollers includes a tension guide, a one-way idle roller and a captive tape guide. The captive tape guide consists of a pair of opposed tape guide rollers, a driven tape feed roller, a nip roller opposite the tape feed roller and a driven platen roller. The tape is wound around the tension guide, over the one-way idle roller and between the opposed tape guide rollers to the tape feed roller. The tape feed roller and the platen roller are mechanically connected to a servo D.C. motor, such as a stepper drive motor, which simultaneously drives the tape feed roller and the platen roller to advance the tape past the print head of the thermal printer.

Preferably, a thermal transfer ribbon is positioned between the print head of the thermal printer and the face of the tape. The thermal transfer ribbon is wound on a ribbon unwind spool rotatably mounted onto a ribbon unwind spool spindle for dispensing the ribbon to the print head, and is tensioned by a ribbon take-up spool rotatably mounted onto a ribbon take-up spool spindle for collecting the ribbon. The ribbon unwind spool and the ribbon take-up spool may be interchanged, or the direction of travel of the thermal transfer ribbon may be reversed in a known manner to increase the service life of the ribbon.

The thermal transfer ribbon is embossed with a dye, or ink, that is transferred to the face of the tape when heat is selectively applied to the print head. A suitable print head is commercially available from any number of manufacturers of thermal printers and thermal transfer printing equipment. However, the ink embossed on the thermal transfer ribbon utilized by the invention must be specially formulated to transfer the ink from the ribbon to the face of the tape and to bond the ink to the substrate of the tape so that the printed information does not bleed into other layers of the tape and does not smear or blur when the tape is applied to the desired surface, or under normal handling conditions. In particular, the ink on the thermal transfer ribbon has a specific formulation that is compatible with the physical and chemical characteristics of the coating on the face of the tape. Preferably, the thermal transfer ribbon and the tape are co-engineered to optimize the adherence, bleed resistance, visibility, flexibility and utility requirements for printing the variable identifying information on the face of the tape.

The one-way idle roller, the opposed tape guide rollers, the tape feed roller and the platen roller are specially designed to support the adhesive side of the tape, if activated, while maintaining consistent alignment of the tape opposite the print head. In particular, the opposed tape guide rollers of the captive tape guide are adjustably mounted on a transverse mounting arm to accurately position the tape. The tape is received between the tape feed roller and the stationary nip roller, and the tape feed roller and the platen roller are mounted on elongate tension arms connected at their opposite ends to the drive shaft of the servo D.C. motor. Together, the tape feed roller, nip roller and platen roller tension and support the adhesive side of the tape opposite the print head of the thermal printer.

Preferably, the opposed tape guide rollers, the tape feed roller and the platen roller have a proprietary coating that prevents the activated adhesive on the tape from accumulating on the exterior surfaces of the rollers. Because the rollers are not coated with a release film, the adhesive does not remove any release film from the rollers, thereby preventing the adhesive on the tape from adequately adhering to the surface on which it is applied. Likewise, the coating on the rollers does not remove any adhesive from the tape, thereby causing the tape to inadequately adhere to the desired surface.

In a particular application, the apparatus is coupled with a conventional case sealer to provide a combined sealing and labeling station along a conveyor on a production line. The variable imaged tape from the thermal printer may be applied to the exterior of the case to label the case as it is being sealed. The tape may be used merely to label the case, or alternatively, may be used to simultaneously label and seal the case with the adhesive sealing tape. In the latter instance, the case is centered on the conveyor beneath the tape dispensing arm as it reaches the sealing and labeling station by a pair of centering guides.

The variable identifying information to be printed on the adhesive sealing tape is electronically transmitted to the print head of the thermal printer. The variable identifying information may be stored in memory for selective transmission to the print head, or may be input by the operator from a conventional keyboard, as each case is received and centered at the combined sealing and labeling station. Certain sealing parameters, such as the length of the tape needed to seal the case, may be electronically transmitted to the tape dispensing arm, or the tape dispensing arm may be mechanically adjusted for the particular length of the case.

In operation, the tape dispensing arm receives the adhesive sealing tape from the platen roller of the captive tape guide in a conventional manner. With the distance between the pair of opposed tape guide rollers adjusted to the width of the adhesive sealing tape, the tape is threaded past the tension guide roller, over the one-way idle roller to the captive tape guide. The tape is then driven by the tape feed roller and the platen roller with the face of the tape opposite the print head and the adhesive side of the tape against the platen roller.

On a print command, the thermal transfer ribbon is dispensed from the ribbon unwind spool, guided between the print head and the face of the adhesive sealing tape and collected by the ribbon take-up spool. In a known manner, the print head of the variable image printer transfers the ink embossed on the thermal transfer ribbon to the face of the adhesive sealing tape so that the variable identifying information is printed on the face of the tape. The adhesive sealing tape is then routed under tension by roller guides to the tape dispensing arm where it is applied to the case and cut in a known manner.

The apparatus may further include a controller for permitting rapid and automatic adjustment of the printing and sealing parameters. Preferably, the controller is located on the thermal transfer printer housing and includes a programmable memory into which the operator can input a predetermined set of printing and sealing parameters. Preferably, the operator inputs the printing and sealing parameters from an operator control panel similar to the operator interface for a conventional computer numerically controlled (CNC) machine. The operator control panel may, for example, be a conventional keyboard or mouse driver that permits the operator to input the necessary printing and sealing parameters or to select a desired set of printing and sealing parameters from a menu of predetermined parameters.

The printing and sealing parameters may, for example, include the variable identifying information to be printed on the tape, the desired size and resolution of the print, the speed of the tape unwind spool, the ribbon unwind spool and the ribbon take-up spools, the amount of leader (i.e., blank tape) desired between each segment of variable image printing, the proper amount of tension to be maintained on the tape and the interval, if any, between repetitions of the variable identifying information. If applicable, the printing and sealing parameters may also include the speed of the conveyor on the production line, the length of the case to be sealed and the length of tape needed to seal the case.

BRIEF DESCRIPTION OF THE DRAWINGS

The foregoing and other objects will become more readily apparent by referring to the following detailed description and the accompanying drawings in which:

FIG. 4*a* is an end view of the thermal printer of FIG. 3*a* taken along line 4*a*—4*a;*

FIG. 4*b* is a sectional view of the thermal printer of FIG. 3*a* taken along line 4*b*—4*b* of FIG. 3*b;*

DETAILED DESCRIPTION OF THE PREFERRED EMBODIMENTS

Figure 1:
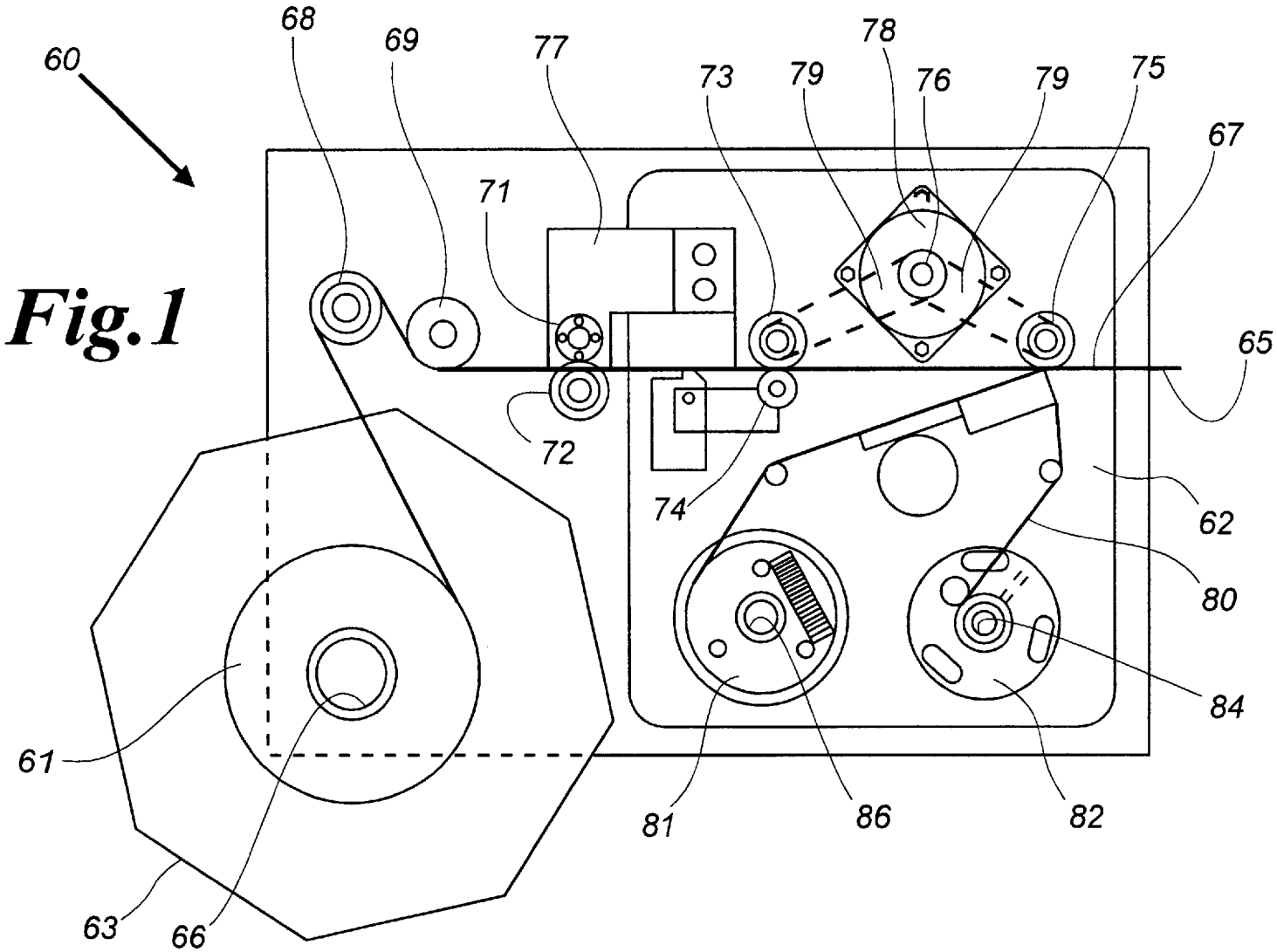
FIG. 1 is a plan view of an apparatus for variable image printing on tape according to the present invention.

FIG. 1 illustrates an apparatus, indicated generally at 60 for variable image printing on tape according to the invention. Preferably, the apparatus 60 comprises a conventional thermal printer 62 which is modified as described in detail hereinbelow. The thermal printer 62 may be a "direct" type thermal printer which includes a print head that receives ink from an ink cartridge, but most preferably is a "transfer" type printer which receives ink from a thermal transfer ribbon, as shown. The thermal printer 62 unwinds and guides the tape 61 from a tape unwind spool 63 to a print head 64 where a thermal transfer ribbon 80 passes between the print head and the tape to transfer the variable printed indicia to the face of the tape by means of the well known thermal transfer process.

The tape 61 may be any continuous, narrow substrate. The tape 61 may be formed of a single layer or may be formed of multiple layers bonded together in a conventional manner, but is preferably flexible enough to be applied with an adhesive to any surface regardless of the contour or irregularity of the surface. It is not necessary that the tape 61 include an adhesive coating, but typically the tape is coated with an adhesive chemical backing on one side. The adhesive backing may be a "dry" adhesive which becomes active when exposed to moisture, or may be a "wet" adhesive which is manufactured in the active state. In the case of a wet adhesive backing, the other side of the tape is typically coated with a release film so that the adhesive does not adhere to the other side of the tape when the tape is wound onto a tape unwind spool.

Most preferably, the tape 61 is the commonly known mylar or acetate tape comprising a first side 65 which is smooth and shiny, and a second side 67 opposite the first side 65 having a wet, or active, chemical adhesive backing thereon. Herein, the first side 65 is also referred to as the "face" of the tape and the second side 67 is also referred to as the "adhesive backing" or "adhesive side" of the tape. In the particular application of labeling and sealing a case described hereinbelow, the tape 61 is, for example, the well known mylar case sealing tape having an active chemical adhesive backing available from Minnesota Mining and Manufacturing Company ("3M Company") of St. Paul, Minn., and commonly referred to as "adhesive sealing tape."

It is well understood by those of ordinary skill in the printing art that printing on the shiny, smooth face 65 of tape presents difficulties which have previously been insurmountable. In particular, the ink from the printer does not bond adequately to the tape when the face 65 of the tape is coated with a release film. Accordingly, the ink from the printer will smear or rub off under even normal handling conditions. The release film, and possibly the substrate itself, may also permit the ink to bleed or run. In either case, the printed indicia on the tape will become illegible within a short period of time.

Another problem is that the temperature required for the printing process can cause the chemical bonds of the release film to breakdown. While the function of the release film is no longer needed once the tape is unwound from the spool, the release film may become discolored and obscure the printed indicia. Still another problem encountered is that the printing processes utilized heretofore have not been fast enough to operate in conjunction with conventional production lines. The thermal printer 62 disclosed hereinafter overcomes these and other problems by virtue of its unique design and construction.

The tape unwind spool 63 of the apparatus 60 is rotatably mounted onto a tape unwind spool spindle 66. The tape 61 is wound on the tape unwind spool 63 in a conventional manner, and the spool rotates freely about the tape unwind spool spindle 66 so that the tape may be unwound from the spool on demand. When a length of the tape 61 is required, the thermal printer 62 routes the tape 61 past the print head 64 to a tape dispensing arm which applies the tape to, for example, a shipping case as is described in the example application discussed hereinbelow. A tape cutter then cuts the tape 61 to the required length for the particular label to be applied to the desired surface.

The thermal printer 62 is provided with a series of tape guides and rollers for delivering the tape 61 to the print head 64 to print the variable identifying information on the tape. The series of tape guides and rollers preferably comprises a tension guide 68, a one-way idle roller 69 and a captive tape guide 70. The captive tape guide 70 preferably comprises a pair of opposed tape guide rollers 71, 72, a driven tape feed roller 73, a nip roller 74 opposite the tape feed roller 73 and a driven platen roller 75. The tape 61 is wound around the tension guide 68, over the one-way idle roller 69 between the opposed tape guide rollers 71, 72 and between the tape feed roller 73 and the nip roller 74. The tape feed roller 73 and the platen roller 75 are mechanically connected to the shaft 76 of a servo D.C. motor 78, such as a stepper drive motor, which simultaneously drives the tape feed roller and the platen roller to advance the tape 61 past the print head 64 of the thermal printer 62.

Preferably, the thermal transfer ribbon 80 is positioned between the print head 64 of the thermal printer 62 and the face 65 of the tape 61. The thermal transfer ribbon 80 is wound on a ribbon unwind spool 81 that is rotatably mounted onto a ribbon unwind spool spindle 86 for dispensing the ribbon to the print head 64, and is tensioned by a ribbon take-up spool 82 rotatably mounted onto a ribbon take-up spool spindle 84 for collecting the ribbon. The ribbon unwind spool 81 and the ribbon take-up spool 82 may be interchanged, or the direction of travel of the thermal transfer ribbon 80 may be reversed in a known manner to increase the service life of the ribbon.

The thermal transfer ribbon 80 is embossed with a dye, or ink, that is transferred to the face of the tape 61 when heat is selectively applied to the print head 64. A suitable print head 64 is commercially available from any number of manufacturers of thermal printers and thermal printing equipment. However, the ink embossed on the thermal transfer ribbon 80 utilized by the invention must be specially formulated for the reasons discussed hereinabove to transfer the ink from the ribbon to the face 65 of the tape 61 and to bond the ink to the substrate of the tape so that the printed information does not bleed into any other layers of the tape and does not smear or blur when the tape is applied to the desired surface, or under normal handling conditions. Accordingly, the ink on the thermal transfer ribbon 80 has a specific formulation that is compatible with the physical and chemical characteristics of any release coating provided on the face 65 of the tape.

Preferably, the thermal transfer ribbon 80 and the tape 61 are co-engineered to optimize the adherence, bleed resistance, visibility, flexibility and utility requirements for printing the variable identifying information on the face 65 of the tape. In particular, the thermal transfer ribbon 80 must be formulated so that the ink does not run, blur, bleed, or become distorted on the surface of the tape 61, and does not weaken the structural integrity of the tape. A suitable thermal transfer ribbon has been formulated, and is available from J.I.T. Technologies, Inc., of Charlotte, N.C., the assignee of the present invention. The thermal transfer ribbon available from J.I.T. Technologies is specially formulated to be compatible with the physical characteristics and chemical composition of tape that has been co-developed with 3M Company of St. Paul, Minn.

The one-way idle roller 69, the opposed tape guide rollers 71, 72, the tape feed roller 73 and the platen roller 75 are specially designed to support the adhesive side 67 of the tape, particularly when the adhesive is active, while maintaining consistent alignment of the tape 61 opposite the print head 64. In particular, the opposed tape guide rollers 71, 72 of the captive tape guide 70 are adjustably mounted on a transverse mounting arm 77 to accurately position the tape relative to the print head 64. The tape 61 is received between the tape feed roller 73 and the stationary nip roller 74. The tape feed roller 73 and the platen roller 75 are mounted on elongate tension arms 79 connected at their opposite ends to the drive shaft 76 of the servo D.C. motor 78. Together, the tape feed roller 73, nip roller 74 and platen roller 75 tension and support the adhesive side 67 of the tape 61 opposite the print head 64 of the thermal printer 62.

Preferably, the opposed tape guide roller 71, the tape feed roller 73 and the platen roller 75 have a proprietary coating that prevents the active adhesive on the tape from accumulating on the exterior surfaces of the rollers. Because the rollers are not coated with a release film, the adhesive does not remove any release film from the rollers, thereby causing the tape to inadequately adhere to the desired surface. Likewise, the coating on the rollers does not remove any adhesive from the tape, thereby causing the tape to inadequately adhere to the desired surface.

Figure 2A:
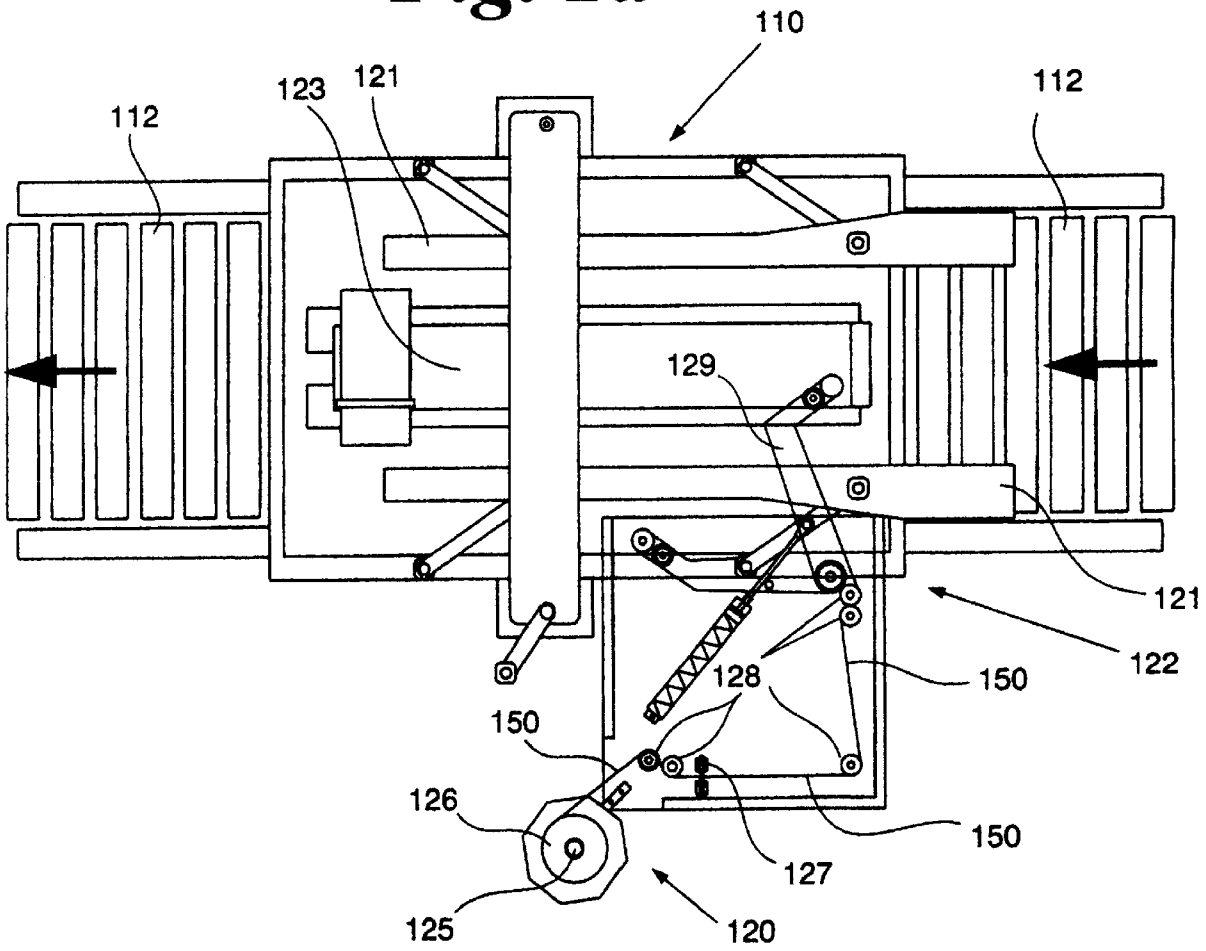
Fig. 2a Prior Art
FIG. 2*a* is a plan view of a prior art station for applying pre-printed adhesive sealing tape to a case on a production line.

FIG. 2*a* illustrates a conventional prior art station, indicated generally at 110, for applying pre-printed adhesive sealing tape 150 to a case on a production line. A pre-printed tape applicator that is particularly well-suited to the invention is manufactured by, and is available from 3M Company of St. Paul, Minn. The station 110 is positioned on the production line adjacent a conveyor 112 for delivering the case to the station from, for example, an upstream packing station (not shown), and for carrying the case away from the station 110 after the case is sealed with the adhesive sealing tape to, for example, a downstream shipping station. The conveyor 112 may comprise a plurality of side-by-side rollers 113, as shown, or may comprise a continuous belt that is driven by a motor about a pair of pulleys.

The station 110 comprises a tape dispensing and guiding means 120, and a tape applying and cutting means 122. The station 110 preferably further comprises adjustable centering and retaining guides 121 for centering and retaining the case on the conveyor 112. A belt 123 may also be provided for holding the case securely against the conveyor 112. The tape dispensing and guiding means 120 preferably comprises a tape spool 126 having a core on which the adhesive sealing tape 150 is wound. The tape spool 126 is rotatably mounted on a tape spool spindle 125 so that the adhesive sealing tape 150 may be unwound from the spool 126 on demand.

The adhesive sealing tape 150 is threaded through the first of a series of roller guides 128, and preferably past a registration mark sensor 127 to properly align the adhesive sealing tape 150 before the tape is applied to the case. The tape applying and cutting means 122 preferably comprises a tape dispensing arm 129 for applying the adhesive sealing tape 150 to the case, and a cutting mechanism (not shown) for cutting the adhesive sealing tape 150 at the appropriate length needed to securely seal the case.

The station 110 is utilized by manufacturers to label or seal cases that contain their products for shipment or storage. It is common practice for the contents of the cases to be identified on the outside of the case with, for example, a product code, such as a stock or lot number, a bar code or shipping data so that the cases can be sorted, routed, stored in inventory or shipped to the proper recipient. In many cases, the identifying information printed on the outside of each case, or a series of cases, is not the same for each case, or for a series of cases. Instead, the identifying information is variable.

For example, a manufacturer may make a first production run of a predetermined number of cases containing a first product, followed immediately by a second production run of the same or a different number of cases containing a second product. Thus, the identifying information printed on the outside of the cases must be changed from the first production run to the second production run to identify the contents or the destination of the first and second products, respectively. In another example, the manufacturer may wish to identify each case of the production run with a unique product code, bar code or shipping data.

In the past, manufacturers have utilized labels, commonly referred to as linerless label stock because the adhesive side of the label is not protected by a liner coated with a release film, that are printed and applied to the case at a separate labeling station. The label may be pre-printed, or may be printed by a variable image printer immediately before the label is applied to the case. The label is then transferred to the case by a pneumatic or hydraulic label tamp. It is readily apparent that increases in productivity, and corresponding decreases in costs, can be obtained if the labeling station and the sealing station are combined, and if the variable identifying information is printed directly on the face of the adhesive sealing tape. The tape (having the variable identifying information printed thereon) may then be applied to an exterior surface of the case in place of the label, or may be used to seal the case in the conventional manner.

Figure 2B:
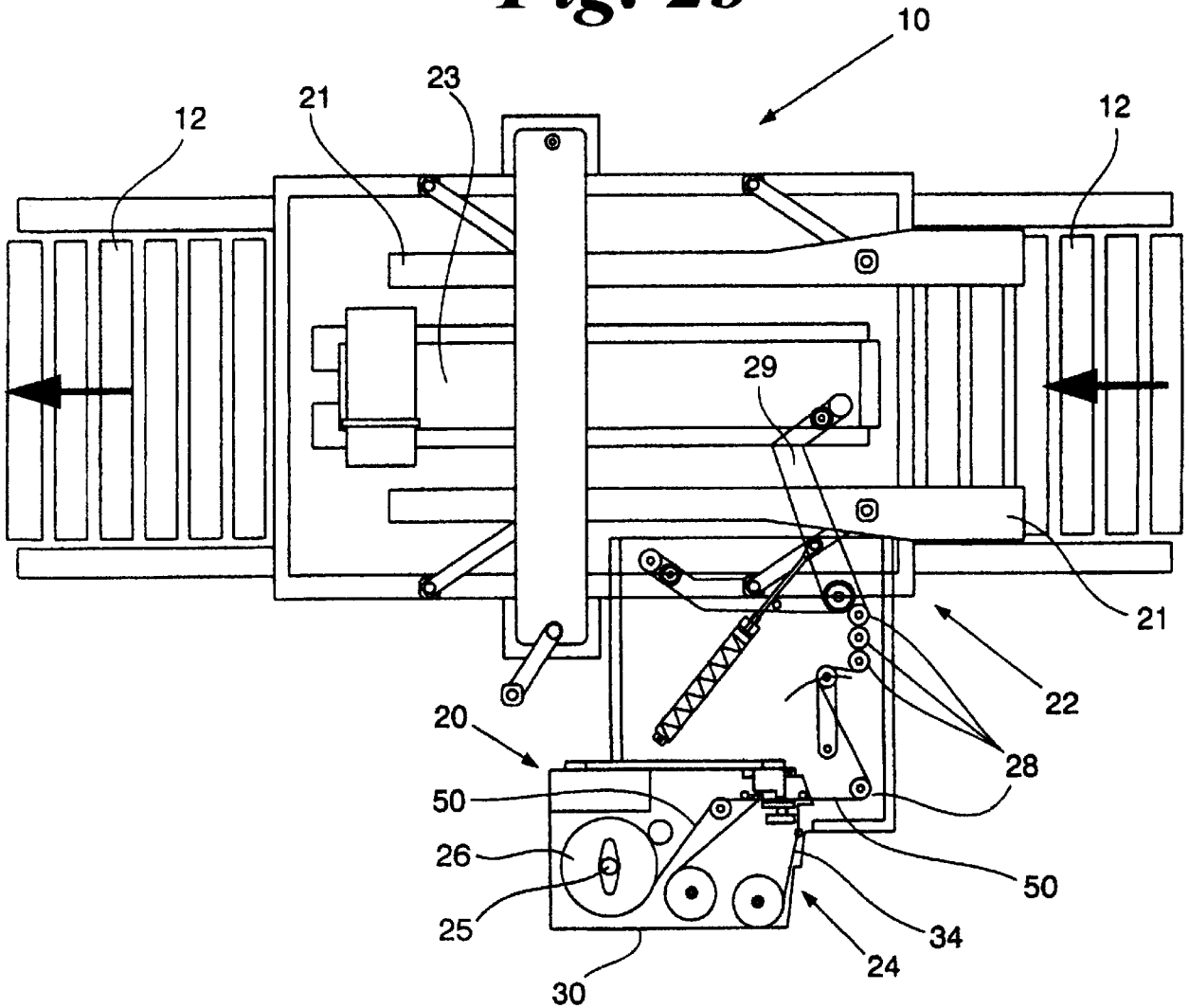
FIG. 2*b* is a plan view of a combined sealing and labeling station according to the invention for printing variable identifying information on the face of adhesive sealing tape, and for applying the adhesive sealing tape to a case on a production line.

FIG. 2*b* illustrates a combined sealing and labeling station, indicated generally at 10, for printing variable identifying information directly onto the face of adhesive sealing tape 50, and for applying the adhesive sealing tape to a case on a production line. The sealing and labeling station 10 is utilized to print the variable identifying information onto the face of the adhesive sealing tape as the tape is applied to an exterior surface of the case in place of a label, or is applied to the case to securely seal the case for shipment or storage. The sealing and labeling station 10 is positioned on the production line adjacent a conveyor 12 for delivering the case to the sealing and labeling station from, for example, an upstream packing station (not shown), and for carrying the case away from the sealing and labeling station after the case is sealed with the adhesive sealing tape to, for example, a downstream shipping station. The conveyor 12 may comprise a plurality of side-by-side rollers 13, as shown, or may comprise a continuous belt that is driven by a motor about a pair of pulleys.

The sealing and labeling station 10 preferably comprises a tape dispensing and guiding means 20, a tape applying and cutting means 22, and a printing means 24. The sealing and labeling station 10 preferably further comprises adjustable centering and retaining guides 21 for centering and retaining a case delivered to the sealing and labeling station on the conveyor 12. A belt 23 may also be provided for holding the case securely against the conveyor 12. The tape dispensing and guiding means 20 comprises a tape spool 26 having a core on which the adhesive sealing tape 50 is wound. The tape spool 26 is rotatably mounted on a tape spool spindle 25 so that the adhesive sealing tape 50 may be unwound from the spool 26 on demand.

The adhesive sealing tape 50 is routed past the printing means 24 to the applying and cutting means 22. A series of roller guides 28 maintain the proper tension on the adhesive sealing tape 50 so that the tape does not buckle or stretch as it is applied to the case. The tape applying and cutting means 22 preferably comprises a tape dispensing arm 29 for applying the adhesive sealing tape 50 centrally to the case, and a cutting mechanism (not shown) for cutting the appropriate length of the adhesive sealing tape 50 needed to label the case, or to securely seal the case.

Figure 3A:
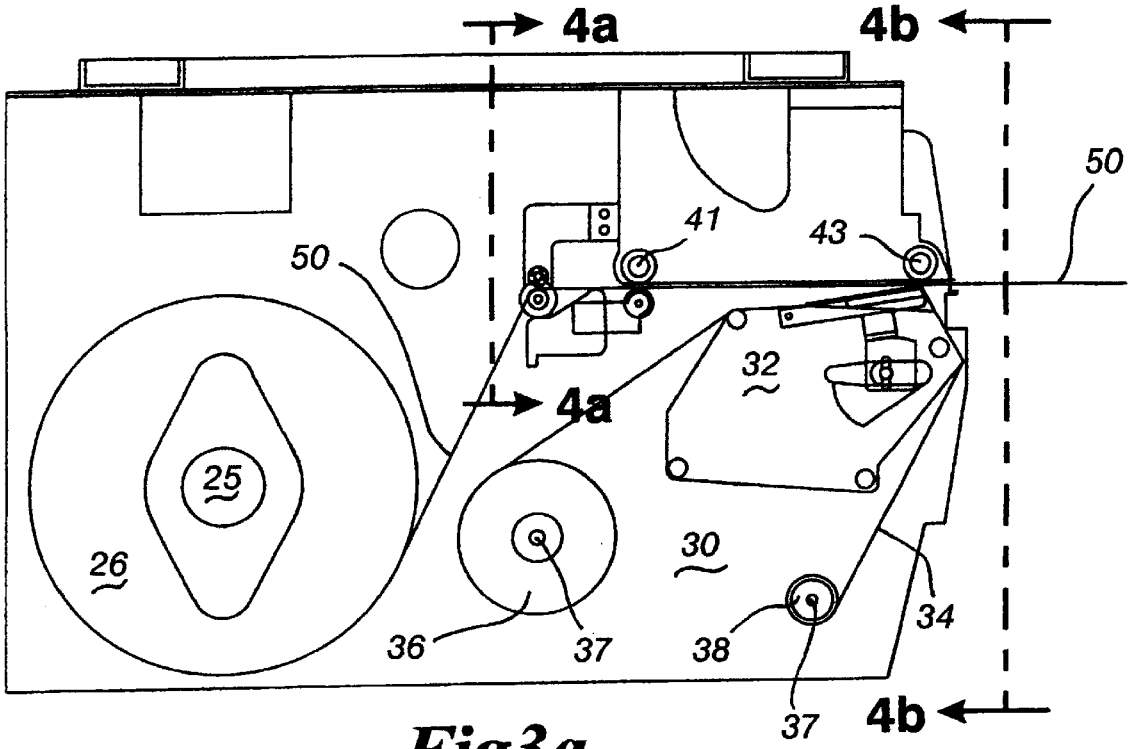
FIG. 3*a* is a plan view of the thermal printer of the combined sealing and labeling station of FIG. 2.
Figure 3B:
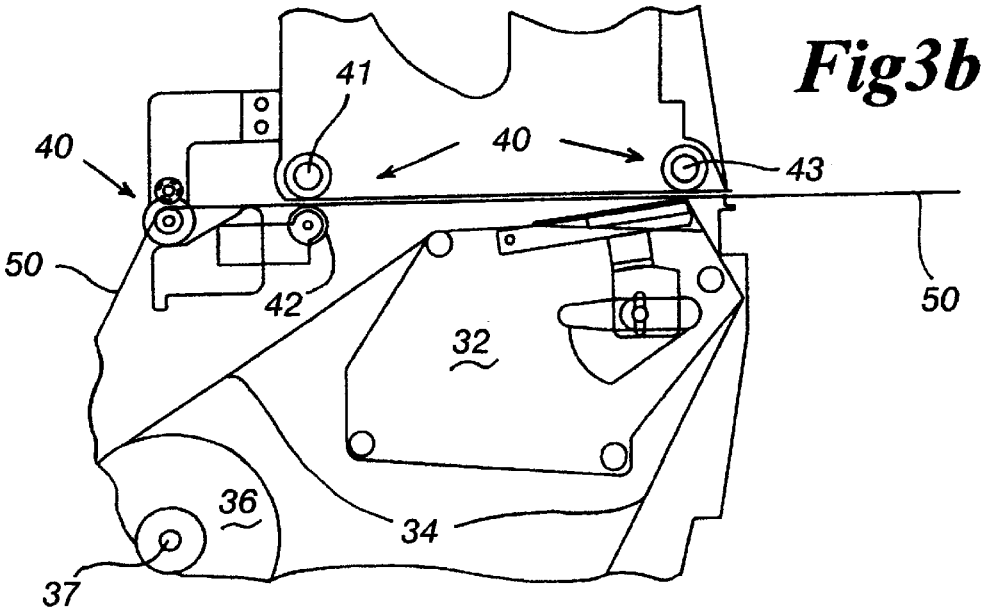
FIG. 3*b* is an enlarged view of the thermal printer of FIG. 3*a*.

As best shown in FIGS. 3*a* and 3*b*, printing means 24 comprises a variable image printer 30. The variable image printer 30 is preferably a thermal transfer printer, but may be any type of variable image printer that is capable of transferring a dye, or ink, onto the face of the adhesive sealing tape 50 without exerting excessive pressure onto the face of the tape. Thus, the adhesive side of the tape 50 will not be pressed hard against, and thus adhere to, any portion of the sealing and labeling station 10. The variable image printer 30 comprises a print head 32 and a thermal transfer ribbon 34 positioned between the print head and the face of the adhesive sealing tape 50.

As previously described, the thermal transfer ribbon 34 has a dye, or ink, embossed thereon that is specially designed to transfer the ink onto the face of the adhesive sealing tape. The thermal transfer ribbon 34 is wound on a ribbon unwind spool 36 rotatably mounted on a ribbon unwind spool spindle 35 for dispensing the ribbon, and is tensioned by a ribbon take-up spool 38 rotatably mounted on a ribbon take-up spool spindle 37 for collecting the ribbon. As is well known, the ribbon unwind spool 36 and the ribbon take-up spool 38 may be interchanged, or the direction of travel of the thermal transfer ribbon 34 may be reversed to increase the service life of the ribbon.

The print head 32 is a conventional thermal transfer print head of the type having a plurality of fine wires depending outwardly from the print head and arranged in a narrow row normal to the direction of travel of the thermal transfer ribbon 34 and the adhesive sealing tape 50. The wires are selectively energized so that heat generated and applied to the thermal transfer ribbon 34 at the tip of the wire liquifies and transfers the ink on the thermal transfer ribbon to the face of the adhesive sealing tape 50. Suitable print heads are well known and are commercially available from a number of acceptable sources.

The variable image printer 30 of the printing means 24 further comprises a captive tape guide 40 (FIG. 3*b*) that is specially designed to support the adhesive side of the adhesive sealing tape 50 while maintaining consistent alignment of the tape opposite the print head 32. The design of the captive tape guide 40 supports the adhesive sealing tape 50 opposite the print head 32 while restricting side to side movement of the tape to prevent the location of the variable identifying information printed onto the tape to vary, or worse yet, to be blurred. The captive tape guide 40 retains the edges and both sides of the adhesive sealing tape 50, as will be described, so that the tape tracks properly as the driven tape feed roller 41 and nip roller 42, and the driven platen roller 43 drive the tape past the print head 32.

As best shown in FIGS. 4*a* and 4*b*, the captive tape guide 40 comprises a pair of opposed upper 44 and lower 46 nip rollers adjustably mounted on a transverse mounting arm 45. The driven platen roller 43 of the captive tape guide 40 supports the adhesive side of the tape 50 opposite the print head 32. The upper 44 and lower 46 rollers, the driven tape feed roller 41 and the driven platen roller 43 have a proprietary coating 47 (FIG. 4*a*) that prevents the adhesive on the tape 50 from accumulating on the rollers. Since the rollers 44, 46, 41 and 43 are not coated with a release film, the adhesive does not remove any release film from the rollers, thereby causing the adhesive sealing tape 50 to inadequately label or seal the case.

In a preferred embodiment, a controller 48 (FIG. 4*b*) is provided for permitting automatic adjustment of the operation of the sealing and labeling station 10. The controller 48 preferably comprises a programmable memory for storing a predetermined set of printing and sealing parameters input by an operator from an operator control panel 49 in a manner similar to a conventional computer numerically controlled (CNC) machine. The operator control panel 49 may, for example, be a keyboard or a mouse driver to input the printing and sealing parameters, or to select a predetermined set of printing and sealing parameters from a menu. The controller 48 may also be utilized to alert the operator of a malfunction in the sealing and labeling station 10, or of a poor print quality condition.

The printing and sealing parameters may, for example, include the variable identifying information to be printed onto the face of the adhesive sealing tape 50, the desired size and resolution of the print, the speed of the tape spool 26 and the ribbon unwind spool 36 and take-up spool 38, the speed of the conveyor 12 on the production line, the amount of leader (i.e., blank tape) desired, the proper amount of tension to be maintained on the sealing tape, the length of the case to be sealed, the appropriate length of the tape needed to seal the case and the interval, if any, between repetitions of the variable identifying information. Typically, the operator inputs a product code, such as a stock or lot number, a bar code, or shipping data, the appropriate length of the tape needed to seal the case and the interval between repetitions of the variable identifying information for each, or for a series, of cases to be received by the sealing and labeling station 10 on the production line.

In operation, the case is delivered to the sealing and labeling station 10 along the conveyor 12 on the production line, and the case is centered and retained on the conveyor beneath the tape dispensing arm 29 by the pair of centering and retaining guides 21. Certain predetermined printing parameters, such as the variable identifying information to be printed onto the face of the adhesive sealing tape and the interval, if any, between repetitions of the variable identifying information, are electronically transmitted to the print head 32 of the variable image printer 30. The printing parameters may be stored in the programmable memory of the controller 48 for selective transmission to the print head 32, or may be input by the operator from the operator control panel 49 as each case is received, centered and retained at the sealing and labeling station. Certain sealing parameters, such as the length of the case and the appropriate length of the adhesive sealing tape 50 needed to seal the case may be electronically transmitted to the tape dispensing arm 29, or the tape dispensing arm may be mechanically adjusted for the length of the case.

The tape dispensing arm 29 unwinds the adhesive sealing tape 50 from the tape spool 26, and the tape is threaded to the captive tape guide 40 so that the face of the tape is exposed to the print head 32 of the variable image printer 30. With the distance between the opposed pairs of upper 44 and lower 46 rollers adjusted to the width of the adhesive sealing tape 50, the tape is threaded through the captive tape guide 40 between the upper and lower rollers. The adhesive sealing tape 50 is then driven by the driven tape feed roller 41 and the nip roller 42 to the driven platen roller 43 so that the face of the tape is opposite the print head 32 and the adhesive side of the tape is against the driven platen roller.

The thermal transfer ribbon 34 is dispensed from the ribbon unwind spool 36, guided between the print head 32 and the face of the adhesive sealing tape and collected by the ribbon take-up spool 38. In a known manner, the print head 32 of the variable image printer 30 transfers the ink embossed on the thermal transfer ribbon 34 to the face of the adhesive sealing tape 50 so that the variable identifying information is printed onto the face of the tape. The adhesive sealing tape 50 is then routed under tension by the series of roller guides 28 to the tape dispensing arm 29 where it is applied to the case and cut.

Figure 5:
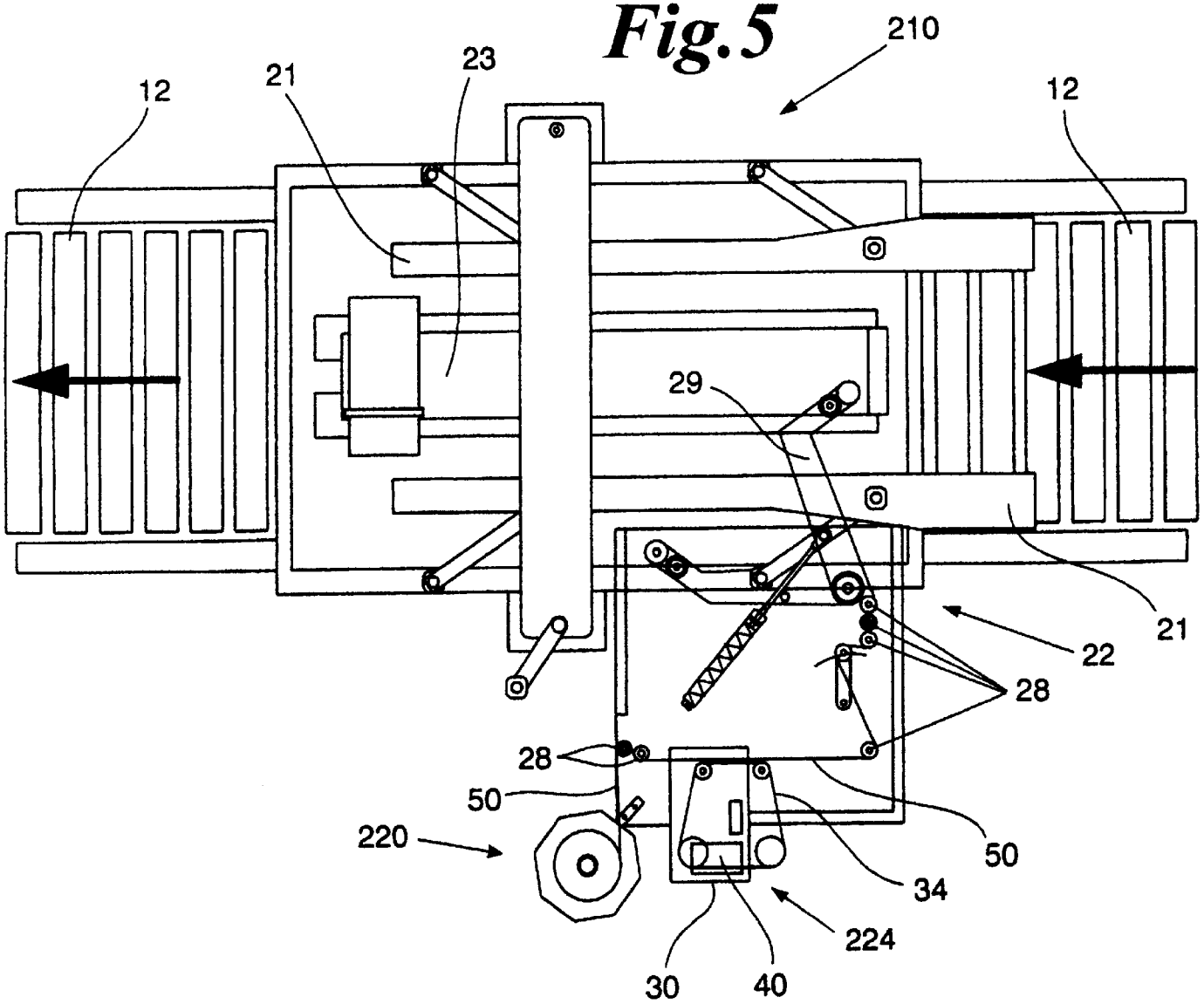
FIG. 5 is a plan view of an alternative embodiment of a combined sealing and labeling station according to the invention for printing variable identifying information on the face of adhesive sealing tape, and for applying the adhesive sealing tape to a case on a production line.

FIG. 5 illustrates an alternative embodiment of a sealing and labeling station, indicated generally at 210, for printing variable identifying information onto the face of adhesive sealing tape 50, and for applying the adhesive sealing tape to a case on a production line. The sealing and labeling station 210 is identical to the sealing and labeling station 10 except for the location and configuration of the dispensing and guiding means 220, and the location and configuration of the printing means 224. The like reference numerals in FIG. 5 indicate like parts of the sealing and labeling station 210 that are unchanged from the sealing and labeling station 10. The operation of the sealing and labeling station 210 is identical to the operation of the sealing and labeling station 10 as previously described. However, the controller 48 of the sealing and labeling station 210 is integrated with the variable image printer 30.

Figure 6:
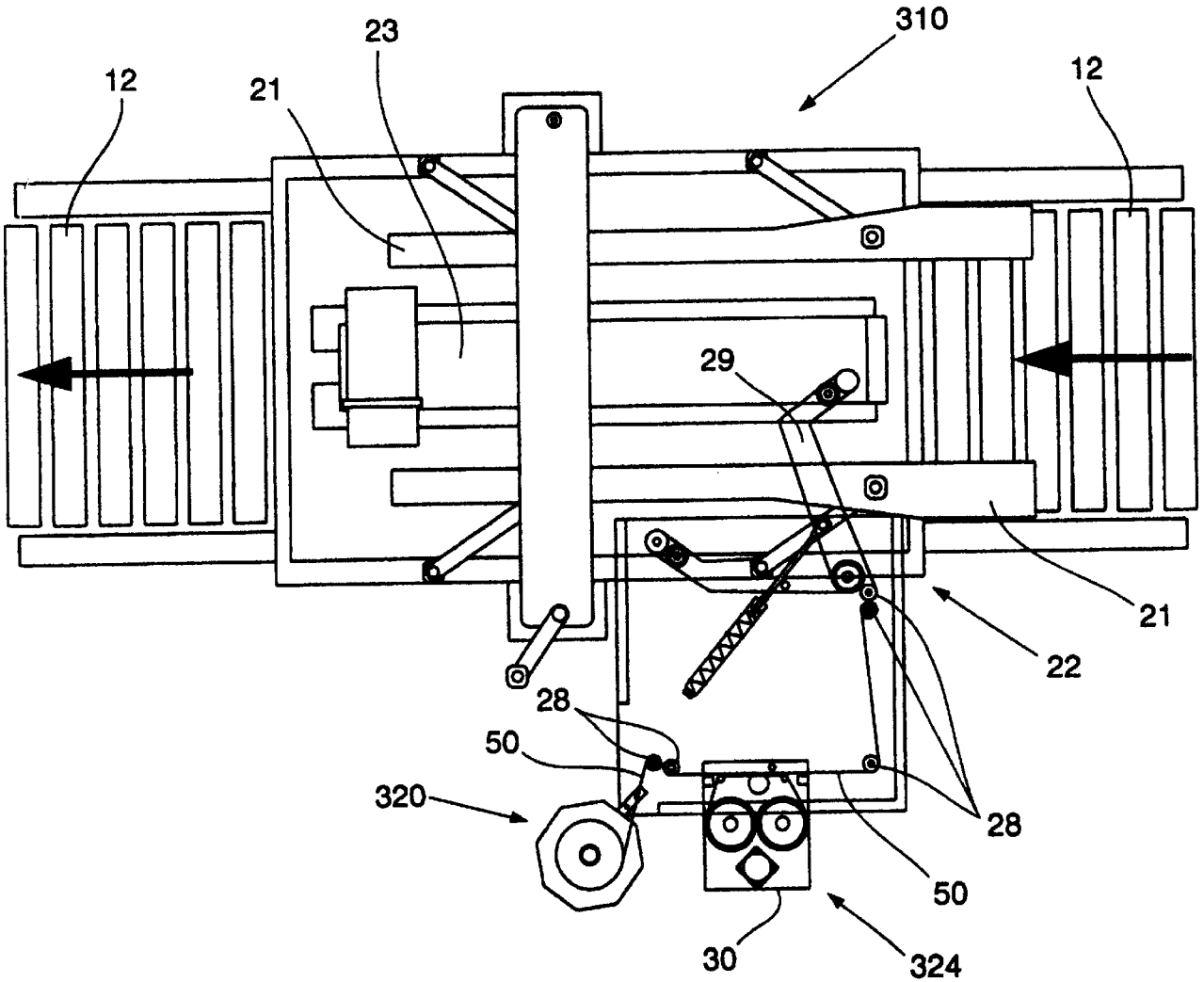
FIG. 6 is a plan view of another alternative embodiment of a combined sealing and labeling station according to the invention for printing variable identifying information on the face of adhesive sealing tape, and for applying the adhesive sealing tape to a case on a production line.

FIG. 6 illustrates an alternative embodiment of a sealing and labeling station, indicated generally at 310, for printing variable identifying information onto the face of adhesive sealing tape 50, and for applying the adhesive sealing tape to a case on a production line. The sealing and labeling station 310 is identical to the sealing and labeling station 10 except for the location and configuration of the dispensing and guiding means 320, and the location and configuration of the printing means 324. The like reference numerals in FIG. 6 indicate like parts of the sealing and labeling station

310 that are unchanged from the sealing and labeling station 10. The operation of the sealing and labeling station 310 is identical to the operation of the sealing and labeling station 10 as previously described. However, the controller 48 of the sealing and labeling station 310 is integrated with the variable image printer 30.

It should now be readily apparent that the invention provides a combined sealing and labeling station for printing variable identifying information onto the face of adhesive sealing tape, and for labeling, sealing or simultaneously labeling and sealing a case with the adhesive sealing tape on a production line. The apparatus permits an operator to program a controller with, or to input, variable identifying information, such as product codes, bar codes, and shipping destinations, to be printed onto the face of the adhesive sealing tape so that each case, or a series of cases, can be identified separately. Further, the combined sealing and labeling station permits variable identifying information to be printed onto the face of adhesive sealing tape without decreasing the productivity of the station, or increasing the complexity and maintenance of the station. Accordingly, the particular need for a variable image printer for printing variable identifying information onto adhesive sealing tape to be applied to a case on a production line is eliminated.

Obviously, many alternative embodiments and modifications of the invention are within the level of ordinary skill of those accomplished in the art of variable image printing. Thus, it is to be understood that the invention is not intended to be limited to the preceding description of the preferred embodiments, or by the preferred embodiments illustrated in the accompanying drawings, but rather is intended to encompass all embodiments that may be devised within the spirit and scope of the invention disclosed herein.

That which is claimed is:

1. An apparatus for printing variable image identifying information on a continuous roll of tape and for applying the tape to a case on a production line, said apparatus comprising:

a roll of tape having a first side and a second side opposite the first side, the first side having a release agent thereon and the second side having an activated chemical adhesive thereon without a liner;

printing means for printing the variable image identifying information on the first side of the tape;

a tape unwind spool spindle;

a tape unwind spool for supporting the roll of tape thereon, said tape unwind spool rotatably mounted onto said tape unwind spool spindle so that the tape is unwound from said tape unwind spool;

a print head;

guide and advancing means for guiding and advancing the tape past said print head, said guide and advancing means having a pair of opposed tape guide rollers, a driven tape feed roller, a stationary nip roller opposite said tape feed roller and a driven platen roller opposite said print head, wherein at least one of said opposed tape guide rollers, said tape feed roller and said platen roller have a coating thereon that prevents the chemical adhesive on the second side of the tape from accumulating on said at least one of said opposed tape guide rollers, said tape feed roller and said platen roller;

applying means for applying the tape to the case on the production line;

a conveyor for delivering the case to said applying means;

adjustable centering and retaining guides for centering and retaining the case on said conveyor;

tape dispensing and guiding means coupled with said printing means for printing the variable image identifying information; and tape applying and cutting means.

2. An apparatus for printing variable image identifying information on a continuous roll of tape and for applying the tape to a case on a production line according to claim 1 wherein said printing means for printing the variable image identifying information is a thermal printer comprising:

a thermal transfer ribbon positioned between said print head and the tape;

a ribbon unwind spool spindle;

a ribbon unwind spool for supporting said thermal transfer ribbon thereon, said ribbon unwind spool rotatably mounted onto said ribbon unwind spool spindle so that said thermal transfer ribbon is dispensed from said ribbon unwind spool past said print head;

a ribbon take-up spool spindle; and a ribbon take-up spool for collecting said thermal transfer ribbon, said ribbon take-up spool rotatably mounted onto said ribbon take-up spool spindle;

wherein said thermal transfer ribbon is embossed with an ink that is transferred to the first side of the tape when heat is selectively applied to said print head and bonds to the tape so that the variable image identifying information printed on the first side of the tape does not bleed into other layers of the tape and does not smear, blur or rub off under normal handling conditions.

3. An apparatus for printing variable image identifying information on a continuous roll of tape and for applying the tape to a case on a production line according to claim 1 further comprising a controller including a programmable memory for receiving and storing a predetermined set of printing and sealing parameters.

4. An apparatus for printing variable image identifying information on a continuous roll of tape and for applying the tape to a case on a production line according to claim 3 wherein the predetermined set of printing and sealing parameters are selected from the group consisting of the variable image identifying information to be printed on the first side of the tape, a size and resolution of the variable image identifying information to be printed on the first side of the tape, an amount of leader between adjacent segments of the variable image identifying information to be printed on the first side of the tape, an amount of tension to be maintained on the tape, an interval between repetitions of the variable image identifying information to be printed on the first side of the tape and a length of the tape to be applied to the case on the production line.

* * * * *